United States Patent [19]

Borel

[11] 4,415,625

[45] Nov. 15, 1983

[54] SPIRAL LINKAGE BELT AND METHOD OF MAKING SAME

[75] Inventor: Georg Borel, Reutlingen, Fed. Rep. of Germany

[73] Assignee: Hermann Wangner GmbH & Co. KG, Fed. Rep. of Germany

[21] Appl. No.: 443,054

[22] Filed: Nov. 19, 1982

[30] Foreign Application Priority Data

Nov. 27, 1981 [DE] Fed. Rep. of Germany ..... 3147115

[51] Int. Cl.[3] ..... D04H 3/02

[52] U.S. Cl. ..... 428/222; 29/433; 59/78; 162/DIG. 1; 428/245; 428/256

[58] Field of Search ..... 29/433; 59/35, 78, 83; 428/222, 223, 245, 256; 162/DIG. 1

[56] References Cited

U.S. PATENT DOCUMENTS 4,346,138 8/1982 Lefferts ..... 428/222

4,362,776 12/1982 Lefferts et al. ..... 428/222

*Primary Examiner*—James J. Bell

[57] ABSTRACT

A spiral linkage belt comprising a multiplicity of intermeshing plastic helices, with the windings of each helix penetrating into the windings of the adjacent helix so that the helices form passageways, and pintle wires extending through each passageway to connect the helices, the spiral linkage belt further including a fabric of interwoven structural warp wires and weft wires connected to the helices.

8 Claims, 3 Drawing Figures

SPIRAL LINKAGE BELT AND METHOD OF MAKING SAME

BACKGROUND OF THE INVENTION

This invention relates to a spiral linkage belt comprising a multiplicity of intermeshing plastic helices arranged so that the windings of one helix enter between the windings of the adjacent helix, and further comprising pintle wires extending through the passageway formed by adjacent helices.

Spiral linkage belts of the aforesaid type have been disclosed in German OS No. 2,419,751, German OS No. 2,938,221 and European Patent Application No. 0 018 200 and are employed, inter alia, as screens in the drying section of papermachines. The use of spiral linkage belts as screens in the drying section of papermachines is possible because at this point in the papermachine operation the sheet forming process of the paper web has been substantially terminated. As a result, the paper web is compacted to such a degree that it no longer is susceptible to marking by the linkage belt. However, heretofore such belts could not be used in the sheet forming section of papermachines on account of the risk of marking.

Another disadvantage of spiral-linkage belts stems from the fact that the belts have very large hollow spaces in their interiors. This causes the belts to carry large volumes of air. At the high speeds of papermachines, these large volumes of air cause the belts to act as air blowers and, as a result, at the belt deflecting points entrained air is discharged causing the paper web to flutter violently or even tear. Attempts have been made to solve this problem by filling the hollow spaces in the spiral linkage belts with bulky yarns or the like. However, the marking problem encountered with the use of such belts in the sheet forming section of a papermachine persists. Additionally, on account of the coarser surface structure the paper fiber retention is insufficient.

It is, therefore, an object of the present invention to provide a spiral linkage belt which is suited for use in the sheet forming section of a papermaking machine.

It is further the object of the present invention to provide a method for producing the spiral linkage belt of the invention.

SUMMARY OF THE INVENTION

In accordance with the principles of the present invention, the above and other objectives are realized in a spiral linkage belt of the above-mentioned type by further including therein a fabric connected to the intermeshed helices of the belt. The connection between the helices and the fabric may be effected in various ways. Preferably binder loops are interwoven into the fabric at spaced intervals on the bottom side of the fabric. These binder loops may be formed from the structural wires of the fabric, or from a wire not included in the fabric structure. This wire may extend either in the warp or in the weft direction.

The proper shape and size of the binder loops may be obtained by interweaving auxiliary wires of predetermined thickness. If the binder loops are formed from warp wires (taken from the structural warp or from an additional binding warp), additional auxiliary weft wires are interwoven in the fabric at predetermined intervals. These auxiliary weft wires are engaged merely by the warp wires contemplated for the formation of the binder loops and thus remain outside the fabric structure on one side thereof.

In a similar way the binder loops may be formed from the weft wire, with the exception that in this case the auxiliary wires extend at certain intervals in the warp direction. These wires are held outside the fabric and are interwoven only at the point of connection by the structural or the additional binder weft wire.

Prior to the assembly of the fabric and the intermeshed helices, the auxiliary wires are pulled out, dissolved, or removed in some other way. The binder loops of the fabric are introduced between the helical windings, and both layers, i.e. the helices and the fabric, are connected by the insertion of connecting wires.

It is especially advantageous to use wire material for the binder loops having a high thermal shrinkage value. The thermal shrinkage of binder loop wire, preferably, should be higher than that of the fabric warp and weft wires and the wires of the helices. During final thermal setting the connecting wires are held taut by the high shrinkage.

The material of the connecting wires may deviate from the material of the fabric and that of the helices. Preferably, the connecting wires comprise a material having a far lower melting temperature than the material of the fabric or that of the helices, e.g. polyamide or polypropylene. In the manufacture of the spiral linkage belt the inserted connecting wires are cut so that they extend a few centimeters beyond the edges. After the final finish, the projecting ends of the connecting wires are fused by thermal or by ultrasonic energy. This results in a good guiding edge along both margins of the spiral linkage belt. There is no embrittlement of the helices or of the fabric on account of the higher melting temperature thereof. In case of ultrasonic welding there is no fusion between the polyester helices and the fused polyamide or polypropylene material of the connecting wires. The fused material of the connecting wires only fills the hollow spaces along the edge of the spiral belt. This mode of producing guide edges along spiral linkage belts is applicable also to the conventional spiral linkage belts.

In lieu of the connecting wires the filling material, if present, may have a lower melting temperature and may be fused at the laterally extending ends to form guide edges.

The margins of the resultant spiral linkage belt may be impregnated with adhesives, if need be, in order to prevent the individual longitudinal wires from disengaging from the edge after a longer time of use.

The helices and the fabric may also be joined together by adhesion or ultrasonic welding either point-wise or area-wise. It is also possible to secure the fabric to the spiral linkage belt by connecting eyes and additionally by adhesion or welding.

The fabric covering may be made endless in a conventional way, e.g. by a woven seam. To this end the fabric may be made endless by a woven seam before the helices are joined, or the helices may be opened by extraction of the pintle wire to facilitate the production of the woven seam joining both ends of the fabric. After completion of the woven seam the helices are joined again by insertion of the pintle wires. Since during use of the spiral linkage belt the helices joined by pintle wires take up the tensile forces, the woven seam may be made very narrow.

An advantage of the spiral linkage belt of the invention is that a very fine structure may be selected for the fabric and thus the desired freedom from marks, good retention of the paper fibers, and the required permeability can be realized. Additionally, the helices may comprise relatively course plastic wires to attain wear resistance and high longitudinal stability.

The fabric-covered spiral linkage belt of the invention may be used in both the sheet forming section of the papermachine, i.e. as papermachine screen, and in the drying section as drying screen for types of paper that are especially susceptible to marking. In addition, it may be used as conveyor belt or as filter medium in all cases where a stable belt with good training properties and at the same time a smooth surface and high retention is required.

The fabric may be woven from monofilaments or from multifilament synthetic resin yarns. It may be additionally provided with a fiber nap by needling which also permits the use in draining presses or in the first stages of the drying section in the manufacture of ultrafine paper types.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
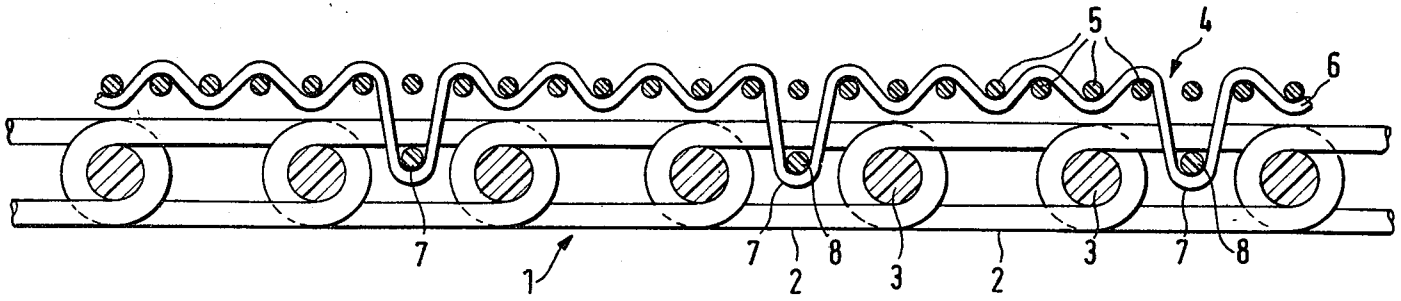
FIG. 1 shows a section through a spiral linkage belt including a single-ply fabric the structural warp of the latter establishing the connection to the helices of the belt.

The spiral linkage belt 1 shown in FIG. 1 comprises intermeshed spirals or helices 2 interconnected by pintle wires 3. The windings of adjacent helices 2 penetrate into one another to such an extent that they form passageways through which the pintle wires 3 can be inserted.

The spiral linkage belt 1 is preferably of the construction described in German OS No. 2,938,221, i.e. the helices 2, in the final belt construction are not subject to a tension spring-like bias, the wire of the helices 2 is free of torsion, and, after engagement of the helices 2 and the insertion of the pintle wires 3, the spiral linkage belt is thermoset under tension so that the windings of the helices 2 are urged somewhat into the material of the pintle wires 3 so as to impart thereto an undular deformation. The arcs or bends of the windings of the helices 2 are preferably enlarged and the pitch of the helices 2 is preferably selected so that the windings are disposed closely side by side, i.e., so that it amounts to about twice the wire thickness. The helices 2 and the pintle wires 3 normally consist of synthetic resin monofilaments.

The fabric 4 comprises weft wires 5 and warp wires woven in plain weave. Every tenth warp wire, for example, serves as binding warp 6, and after a certain number of weft wires—in the present case eight weft wires 5—the binding warp forms a binder loop 7. The ratio between normal warp wires and binding warp 6 can be selected according to individual requirements, and, in the extreme case, each warp wire can be a binding warp 6.

The binder loops 7 are long enough to extend into the interior of the helices 2 when the fabric 4 is placed thereon. Hence, the fabric 4 can be bonded to the helices by inserting connecting wires 8 through the space defined by the portions of the binder loops 7 extending into the helices.

Figure 2:
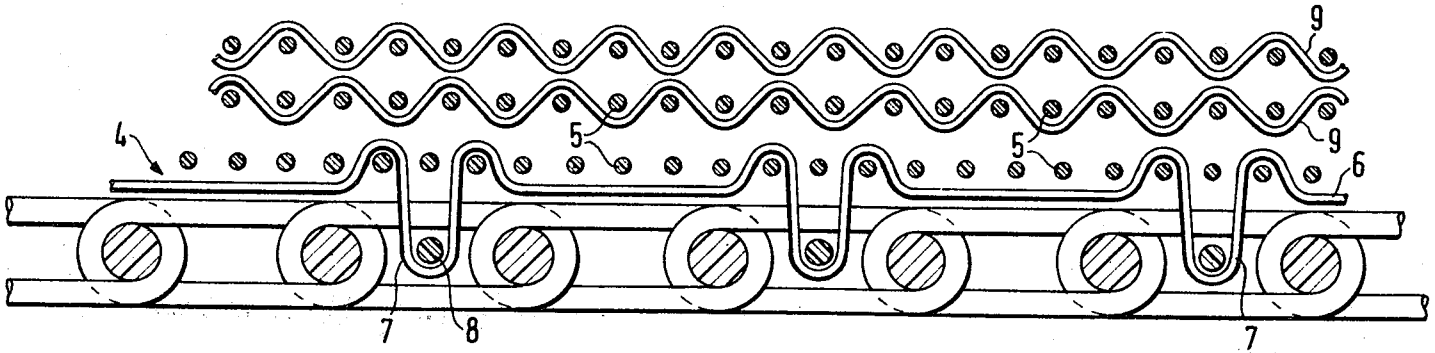
FIG. 2 is a section through a spiral linkage belt including a single-ply fabric connected to the helices of the belt by a special binding warp, and the course of two structural warp wires of the fabric.

FIG. 2 shows a section similar to that of FIG. 1 of another embodiment of the spiral linkage belt of the invention. In this case, the binder loops 7 are formed by a special binding warp 6. For reasons of clarity the course of the structural warp wires 9 in FIG. 2 is shown separately.

The binding warp 6 passes over the two weft wires 5 directly ahead of and behind a binder loop and otherwise extends underneath the weft wires 5. The binding warp 6 forming the binder loops 7 can be interwoven in the course of the manufacture of the fabric 4, or can be threaded into the fabric later on. The structural warp wires 9 and the weft wires 5 again form a plain weave. However, any other weave may be selected.

Figure 3:
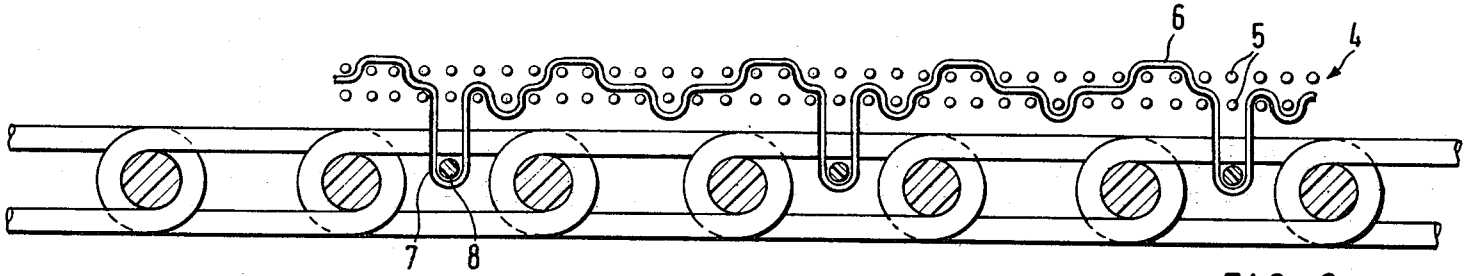
FIG. 3 illustrates a spiral linkage belt including a two-ply fabric.

In the embodiment invention illustrated in FIG. 3, the fabric 4 is a two-ply fabric, i.e. the weft wires 5 are arranged in two layers, and at least a part of the warp wires 9 is woven into both layers. Additionally, the binding warps 6 are woven into both layers. The use of a two-ply fabric 4 improves the retention capability and reduces the marking effect of the belt so that it may be employed in the sheet forming section of the papermachines used in the manufacture of ultrafine papers.

EXAMPLES

A spiral linkage belt similar to that shown in FIG. 2 is to be produced.

The spiral linkage belt is made from monofilamentary polyester wires. The helices have seven windings per centimeter and comprise a monofilamentary polyester wire of 0.70 mm diameter. The pintle wires made from polyester monofilament have a thickness of 0.90 mm and are spaced apart 5 mm. The structure of helices and pintle wires has a thickness of 2.50 mm and an air permeability of 970 cfm.

The fabric is woven in plain weave. The warp count is 28 wires/cm. The warp has a thickness of 0.17 mm and is made from polyester monofilaments having a heat shrinkage of 11.5% at 200° C. The weft wire count is likewise 28 wires/cm. The weft wires are made from polyester monofilaments of 0.18 mm diameter and have a heat shrinkage of 2.2%. The air permeability of the top layer is 416 cfm, the air permeability of both fabric layers taken together is 403 cfm.

The binding warp wire is a polyester monofilament of 0.17 mm diameter and has a heat shrinkage of 24.5%. It extends after each 14th warp wire and forms the binder loops after each 28th weft wire.

The connecting wires between the fabric and the helices comprise polyester monofilaments.

In a further and otherwise identical example the monofilamentary connecting wires comprise polyamide or polypropylene having a lower melting point (130 to 210° C.) than the polyester wires (254° C.) to permit welding of the fabric edges. When the edges are welded with an ultrasonic device only the polyamide or polypropylene wire is fused and provides the necessary bond at the fabric margin without the wires of the fabric and the helices also being fused.

What is claimed is:

1. A spiral linkage belt comprising: a multiplicity of intermeshing plastic helices with the windings of each helix entering between the windings of an adjacent helix to form a passageway; and a pintle wire extending through each said passageway and connecting the helices forming that passageway; and said belt being characterized in that it further includes a fabric of interwoven structural warp wires and weft wires secured to said helices.

2. A belt in accordance with claim 1 further characterized in that a binding warp wire is woven into the fabric to form projecting binder loops which enter into the interior of the helices; and a connecting wire extends through each binder loop to anchor that loop to the helix into which that loop enters.

3. A belt in accordance with claim 3 further characterized in that the material of the binding warp has a higher thermal shrinkage value than the material of the structural warp wires.

4. A belt in accordance with claim 1 further characterized in that the material of the connecting wires has a lower melting point than the material of the helices.

5. A method of making a spiral linkage belt, said belt comprising: a multiplicity of intermeshing helices with the windings of each helix entering between the windings of an adjacent helix to form a passageway; and a pintle wire extending through each said passageway and connecting the helices forming that passageway; a fabric of interwoven structural warp wires and weft wires; and a binder warp wire carried by said fabric to form projecting binder loops; said method being characterized in that: the fabric is placed on the helices with the side of the fabric from which the binder loops extend being adjacent the helices and such that the binder loops enter into the interior of the helices; and connecting wires are passed through the interior of the helices and through the binder loops extending into the interior of the helices.

6. A method in accordance with claim 5 in which the binder warp is interwoven into the fabric.

7. A method in accordance with claim 5 in which the binder warp is comprised of structural warp wires of the fabric.

8. A method in accordance with claim 5 further characterized in that a material of high thermal shrinkage is used for the binder loops and the spiral linkage belt is thermostat after mounting of the fabric.

* * * * *